US010146158B2

(12) United States Patent
Yamaguchi et al.

(10) Patent No.: US 10,146,158 B2
(45) Date of Patent: Dec. 4, 2018

(54) IMAGE FORMING APPARATUS AND FIXING DEVICE WITH LUBRICANT RETAINING SPACE HAVING A VARIABLE VOLUME

(71) Applicant: Konica Minolta, Inc., Chiyoda-ku, Tokyo (JP)

(72) Inventors: Masahiro Yamaguchi, Toyokawa (JP); Shoichi Yoshikawa, Okazaki (JP); Koji Yamamoto, Toyokawa (JP); Seiji Shibata, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/685,779

(22) Filed: Aug. 24, 2017

(65) Prior Publication Data

US 2018/0067432 A1 Mar. 8, 2018

(30) Foreign Application Priority Data

Sep. 2, 2016 (JP) ..... 2016-171666

(51) Int. Cl.
*G03G 15/20* (2006.01)

(52) U.S. Cl.
CPC ..... *G03G 15/2028* (2013.01); *G03G 15/2025* (2013.01); *G03G 15/2053* (2013.01); *G03G 2215/0129* (2013.01); *G03G 2215/2032* (2013.01)

(58) Field of Classification Search
CPC ..... G03G 15/2053; G03G 15/2064; G03G 15/2067; G03G 15/2075; G03G 15/2085; G03G 2215/2032; G03G 2215/2093; G03G 2215/0129; G03G 15/2028; G03G 15/2025
See application file for complete search history.

(56) References Cited

U.S. PATENT DOCUMENTS

2015/0198919 A1* 7/2015 Lee ..... G03G 15/2075 399/329
2017/0269526 A1* 9/2017 Yuasa ..... G03G 15/2089
2018/0017910 A1* 1/2018 Sawada ..... G03G 15/2075

FOREIGN PATENT DOCUMENTS

JP 2015-166796 A 9/2015
JP 2016-048325 A 4/2016

* cited by examiner

*Primary Examiner* — Sophia S Chen
(74) *Attorney, Agent, or Firm* — Buchanan Ingersoll & Rooney PC

(57) ABSTRACT

An image forming apparatus includes a fixing device that forms a fixing nip by a pressure rotator and a fixing belt that rotates while contacting the pressure rotator, and includes: a nip former that is disposed inside the fixing belt and that forms the fixing nip between the pressure rotator and the fixing belt; and a lubricant supplier that forms a lubricant-retaining space at a position between an inner surface of the fixing belt and the nip former on an upstream side of the nip former in a rotation direction of the fixing belt, wherein the lubricant supplier varies a volume of the lubricant-retaining space.

21 Claims, 9 Drawing Sheets

IMAGE FORMING APPARATUS AND FIXING DEVICE WITH LUBRICANT RETAINING SPACE HAVING A VARIABLE VOLUME

Japanese Patent Application No. 2016-171666 filed on Sep. 2, 2016, including description, claims, drawings, and abstract the entire disclosure is incorporated herein by reference in its entirety.

BACKGROUND

Technological Field

The present invention relates to an image forming apparatus provided with a fixing device.

Description of the Related Art

In an image forming apparatus such as a copying machine, a printer, or a facsimile, a heat fixing method has been widely adopted as a method for fixing an unfixed toner image transferred to a recording medium such as paper to the paper. As a fixing device, there is known one including a pressure roller and an endless belt that rotates while contacting the pressure roller. Furthermore, this fixing device includes a heating portion that heats the belt and a nip former that contacts the inner surface of the belt and forms a fixing nip portion between the pressure roller and the belt.

In the above fixing device, lubricant is interposed between the inner surface of the belt and the nip former in order to smoothly rotate the belt. In order to maintain favorable fixing properties, it is necessary to maintain an appropriate amount of the lubricant between the inner surface of the belt and the nip former. With respect to such a technique, examples of conventional image forming apparatuses and fixing devices are disclosed in JP 2016-48325 A and JP 2015-166796 A.

The image forming apparatus described in JP 2016-48325 A includes a fixing roller, an endless fixing belt, a pressure pad that presses the fixing belt toward the fixing roller, and a lubricant applying roller that is disposed on an upstream side of the pressure pad in a belt rotation direction and that contacts the inner surface of the fixing belt. The lubricant applying roller is driven to rotate by the fixing belt. Lubricant scraped off from the inner surface of the fixing belt adheres to the lubricant applying roller on the upstream side of the pressure pad in the belt rotation direction, and the lubricant can be applied again to the inner surface of the fixing belt.

The fixing device described in JP 2015-166796 A includes an endless fixing film, a guide member included in the fixing film, and a pressure roller that is pressed against the guide member through the fixing film to form a nip portion. The fixing film is driven to rotate by the pressure roller. In this fixing device, the pressure roller (fixing film) is rotated at a predetermined timing in a direction opposite to a direction at the time of normal fixing. This makes it possible to supply, to the nip portion again at the time of the reverse rotation, heat resistant grease accumulated on a downstream side of the guide member in the rotation direction of the film at the time of normal fixing.

However, in the image forming apparatus described in JP 2016-48325 A, it is necessary to generate torque that prevents the lubricant applying roller from slipping by the lubricant in order to rotationally drive the lubricant applying roller by the fixing belt. For this reason, it is necessary to make the diameter, surface friction coefficient and drag of the lubricant applying roller comparatively large. There is a problem that when the diameter of the lubricant applying roller is increased, the fixing belt may become long, the apparatus may become large, and the cost may increase. There is a problem that when the diameter of the lubricant applying roller is reduced and the friction coefficient is increased, rubbing with the fixing belt may occur due to a rotation failure. There is a problem that when the diameter of the lubricant applying roller is reduced and the drag is increased, the belt may be damaged due to excessive tension of the fixing belt.

Furthermore, in the fixing device described in JP 2015-166796 A, abrasion powder may be generated by friction between the inner surface of the fixing film and the guide member at the time of normal fixing and discharged on the downstream side of the guide member in the rotation direction of the film, and the abrasion powder may enter the nip portion again at the time of the reverse rotation. As a result, there are problems of wear promotion and breakage of the fixing film. Furthermore, it may take a relatively long time to reversely rotate the pressure roller to spread the grease over the entire area of the nip portion. As a result, it is necessary to set the operation time of the reverse rotation to long time and frequently perform the reverse rotation. Therefore, there are problems such as reduction in productivity associated with printing, waste of electric power, and noise.

SUMMARY

The present invention has been made in view of the above points, and an object of the present invention is to provide an image forming apparatus capable of reducing the size and cost, extending the life thereof, and maintaining favorable fixing properties.

To achieve the abovementioned object, according to an aspect of the present invention, an image forming apparatus reflecting one aspect of the present invention comprises a fixing device that forms a fixing nip by a pressure rotator and a fixing belt that rotates while contacting the pressure rotator, and comprises: a nip former that is disposed inside the fixing belt and that forms the fixing nip between the pressure rotator and the fixing belt; and a lubricant supplier that forms a lubricant-retaining space at a position between an inner surface of the fixing belt and the nip former on an upstream side of the nip former in a rotation direction of the fixing belt, wherein the lubricant supplier varies a volume of the lubricant-retaining space.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

First Embodiment

Figure 1:
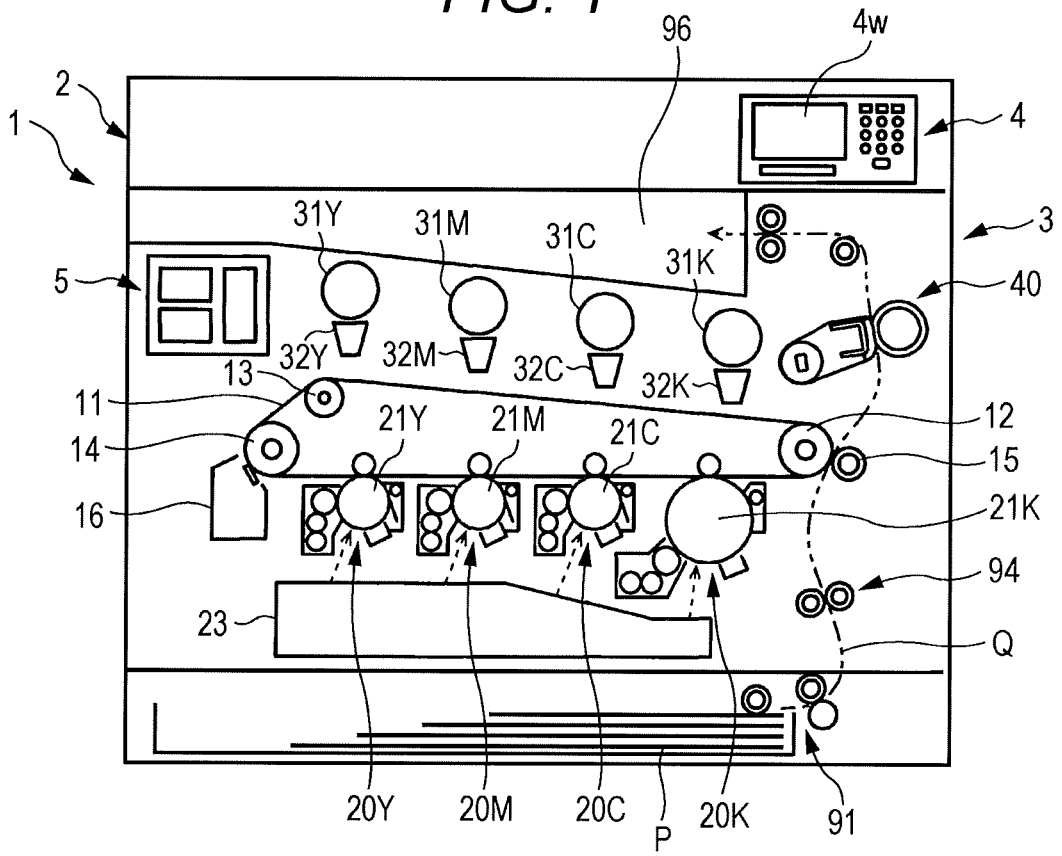
FIG. 1 is a partial vertical sectional front view of an image forming apparatus according to a first embodiment of the present invention.

First, an image output operation of an image forming apparatus according to a first embodiment of the present invention will be described while schematically describing a structure of the image forming apparatus with reference to FIG. 1. FIG. 1 is an example of a partial vertical sectional front view of the image forming apparatus. Note that in the figure, a two-dot chain line with an arrow indicates a transport path and a transport direction of a sheet of paper.

As illustrated in FIG. 1, an image forming apparatus 1 is a so-called tandem type color copying machine, and includes an image reading unit 2 that reads an image of a document, a printing unit 3 that prints the read image on a sheet of paper, an operation unit 4 that inputs printing conditions and displays an operational status, and a main control unit 5.

The image reading unit 2 is a known one that reads an image of a document placed on the upper surface of a platen glass (not illustrated) by moving a scanner (not illustrated). The image of the document is separated into three colors of red (R), green (G), and blue (B), and is converted into an electric signal by a charge coupled device (CCD) image sensor (not illustrated). As a result, the image reading unit 2 obtains image data for each color of red (R), green (G), and blue (B).

Figure 3:
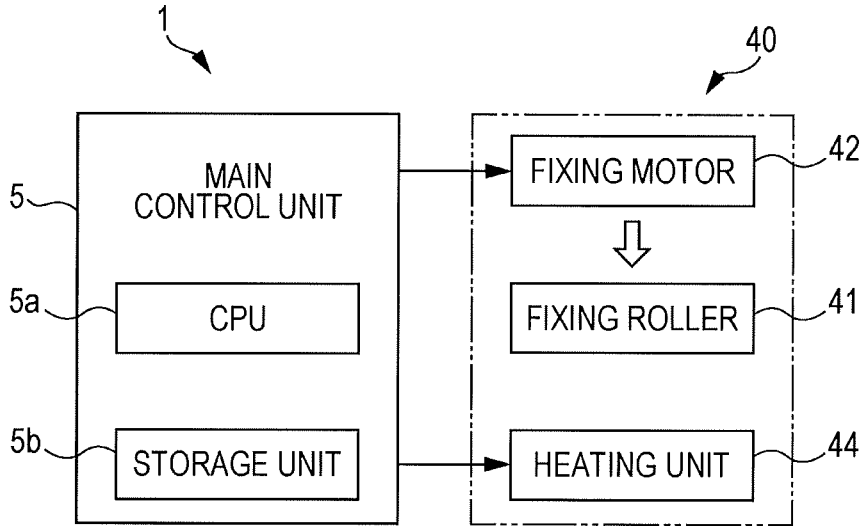
FIG. 3 is a block diagram illustrating a configuration of the fixing device of the image forming apparatus according to the first embodiment of the present invention.

The image data for each color obtained by the image reading unit 2 is subjected to various processes in the main control unit 5, converted into image data of each reproduction color of yellow (Y), magenta (M), cyan (C), and black (K) and stored in a storage unit 5*b* of the main control unit 5 (refer to FIG. 3). The image data for each reproduction color stored in the storage unit 5*b* is subjected to a process for correcting a positional deviation and then is read for each scanning line in synchronization with the transport of the sheet of paper in order to perform optical scanning with respect to a photosensitive drum 21 that is an image carrier.

The printing unit 3 forms an image by an electrophotographic method and transfers the image to paper. The printing unit 3 includes an intermediate transfer belt 11 in which an intermediate transfer member is formed as an endless belt. The intermediate transfer belt 11 is wound around a driving roller 12 and driven rollers 13 and 14. The intermediate transfer belt 11 rotates in the counterclockwise direction in FIG. 1 by the driving roller 12.

The driving roller 12 presses and contacts a secondary transfer roller 15 facing the driving roller 12 across the intermediate transfer belt 11. At the position of the driven roller 14, an intermediate transfer cleaning unit 16 provided so as to face the driven roller 14 across the intermediate transfer belt 11 contacts the outer peripheral surface of the intermediate transfer belt 11. After a toner image formed on the outer peripheral surface of the intermediate transfer belt 11 is transferred to the paper, the intermediate transfer cleaning unit 16 removes and cleans deposits such as toner remaining on the outer peripheral surface of the intermediate transfer belt 11.

Image forming units 20Y, 20M, 20C, and 20K corresponding to the reproduction colors of yellow (Y), magenta (M), cyan (C), and black (K) respectively are provided below the intermediate transfer belt 11. In this description, the description of the identification symbols of "Y", "M", "C", and "K" is omitted and the image forming units are sometimes collectively referred to as, for example, "image forming units 20", except for a case where it is particularly necessary to limit the image forming unit. Four image forming units 20 are disposed in a row from the upstream side to the downstream side in the rotation direction of the intermediate transfer belt 11 along the rotation direction. The four image forming units 20 have the same configuration, and each include a charging unit, an exposure unit, a developing unit, a drum cleaning unit, and a primary transfer roller that are disposed around the photosensitive drum 21 that rotates in the clockwise direction in FIG. 1.

Above the intermediate transfer belt 11, there are provided four toner bottles 31 and four toner hoppers 32 corresponding to the image forming units 20 of respective reproduction colors. The developing unit and the toner hopper 32 are each provided with a remaining toner detection unit (not illustrated) that detects the amount of toner in the developing unit or the toner hopper 32. Furthermore, a toner replenishing device (not illustrated) is provided between the developing unit and the toner hopper 32 and between the toner hopper 32 and the toner bottle 31. When a decrease in the amount of toner in the developing unit is detected by the remaining amount detection unit, the replenishing device drives the toner hopper 32 to supply toner to the developing unit. Furthermore, when a decrease in the amount of toner inside the toner hopper 32 is detected by the remaining amount detection unit, the replenishing device drives the toner bottle 31 to replenish the toner hopper 32 with toner. The toner bottle 31 is detachably provided to the main body of the apparatus and can be replaced with a new one as appropriate.

A scanning optical device 23 that is an exposure unit is disposed below the image forming units 20. One unit of the scanning optical device 23 corresponds to the four image forming units 20, and includes four light sources such as semiconductor lasers (not illustrated) individually corresponding to the four photosensitive drums 21. The scanning optical device 23 modulates the four semiconductor lasers according to image gradation data of each reproduction color and individually outputs the laser light corresponding to each reproduction color to the four photosensitive drums 21.

A paper supply device 91 that loads and accommodates a plurality of sheets of paper P is provided below the scanning optical device 23. The paper P accommodated inside the paper supply device 91 is sequentially sent to a paper transport path Q one by one from the uppermost layer of the paper P. The paper P sent from the paper supply device 91 to the paper transport path Q reaches a registration roller pair 94. Then, the registration roller pair 94 sends the paper P toward a contact portion (secondary transfer nip portion) between the intermediate transfer belt 11 and the secondary transfer roller 15, in synchronization with the rotation of the intermediate transfer belt 11 while correcting the diagonal feed of the paper P (skew correction).

In the image forming units 20, an electrostatic latent image is formed on the surface of the photosensitive drum 21 by the laser beam emitted from the scanning optical device 23, and the electrostatic latent image is visualized as a toner image by the developing unit. The toner image formed on the surface of the photosensitive drum 21 is primarily transferred to the outer peripheral surface of the intermediate transfer belt 11 at a position where the photosensitive drum 21 faces the primary transfer roller across the intermediate transfer belt 11. As the intermediate transfer belt 11 rotates, the toner images of the respective image forming units 20 are sequentially transferred to the intermediate transfer belt 11 at a predetermined timing, whereby the toner images of the four colors, that is, yellow, magenta, cyan, and black are superimposed on each other, and as a result, a color toner image is formed on the outer peripheral surface of the intermediate transfer belt 11.

The color toner image primarily transferred to the outer peripheral surface of the intermediate transfer belt 11 is sent to the paper P sent synchronously by the registration roller pair 94. Then, the color toner image is transferred to the paper P at the secondary transfer nip portion formed by bringing the intermediate transfer belt 11 and the secondary transfer roller 15 into contact with each other.

A fixing device 40 is provided above the secondary transfer nip portion. The paper P to which an unfixed toner image has been transferred at the secondary transfer nip portion is sent to the fixing device 40, and the toner image is heated and pressed to be fixed on the paper P. The paper P that has passed through the fixing device 40 is discharged to a paper discharge unit 96 provided above the intermediate transfer belt 11.

The operation unit 4 is provided on the front side of the image reading unit 2. The operation unit 4 receives, for example, inputs of settings such as printing conditions including the type and size of the paper P used for printing by the user, enlargement/reduction, presence or absence of double-sided printing, and inputs of settings such as a fax number and a sender name in a facsimile transmission. Furthermore, the operation unit 4 also functions as a notification unit that notifies the user of, for example, a status, notes, and error messages of the apparatus by displaying them on a display unit 4*w*.

Furthermore, the image forming apparatus 1 is provided with the main control unit 5 including a central processing unit (CPU) 5*a*, an image processing unit, and other electronic parts (not illustrated) (refer to FIG. 3) to control the overall operation of the image forming apparatus 1. The main control unit 5 uses the CPU 5*a* that is a central processing unit and the image processing unit, and controls constituent components such as the printing unit 3 including the image forming units 20, the fixing device 40, and the like and the image reading unit 2, on the basis of a program and data stored and input in the storage unit 5*b*. Thus, the main control unit 5 achieves a series of image forming operations and printing operations.

Figure 2:
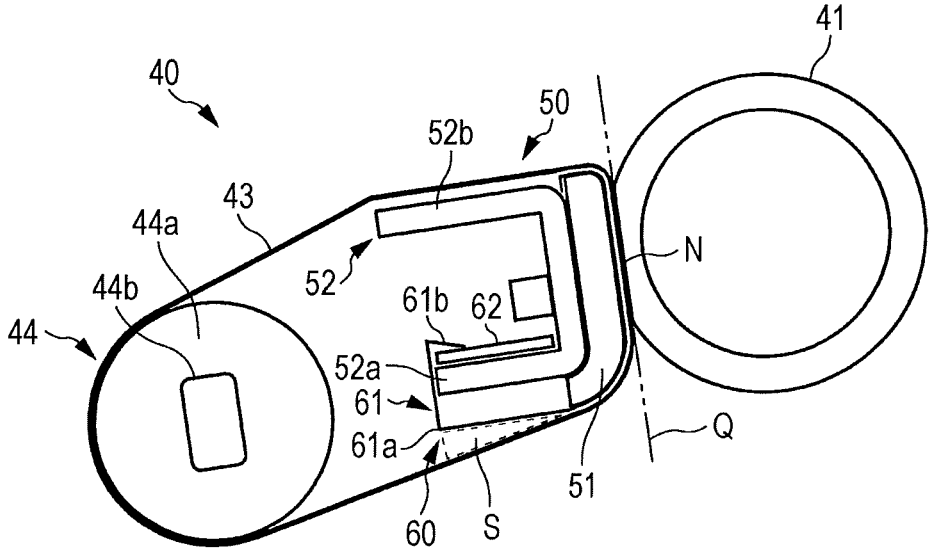
FIG. 2 is a front view of a fixing device of the image forming apparatus according to the first embodiment of the present invention.
Figure 4:
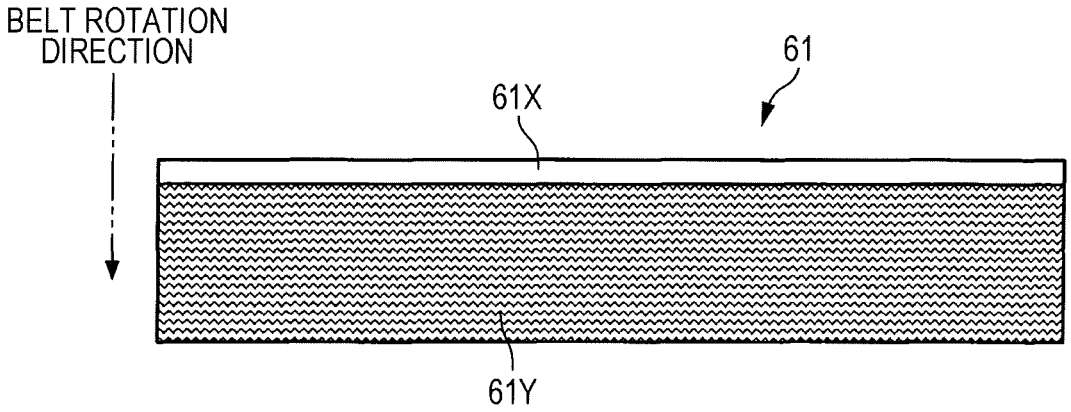
FIG. 4 is a bottom view of a sheet material of a lubricant supplier of the fixing device of the image forming apparatus according to the first embodiment of the present invention.

Next, a detailed configuration of the fixing device 40 will be described with reference to FIGS. 2 to 4. FIG. 2 is a front view of the fixing device 40. FIG. 3 is a block diagram illustrating the configuration of the fixing device 40 of the image forming apparatus 1. FIG. 4 is a bottom view of a sheet material of a lubricant supplier of the fixing device 40.

As illustrated in FIGS. 2 and 3, the fixing device 40 includes a fixing roller 41 that is a pressure roller, a fixing motor 42, a belt 43, a heating unit 44, and a nip former 50.

The fixing roller 41 has a cylindrical shape, and its axis of rotation extends in the paper width direction, that is, along the front-back direction of the image forming apparatus 1. The fixing roller 41 has a length longer than an entire area in the paper width direction of the paper transport path Q. The fixing roller 41 has a laminated structure including an elastic layer and the like on the surface of which a release layer (for example, fluorine coating) is provided.

A predetermined pressure is applied to the fixing roller 41 by a pressure mechanism using a pressure spring (not illustrated) or the like. The peripheral surface of the fixing roller 41 presses and contacts the nip former 50 via the belt 43 to form a fixing nip portion N. In the fixing nip portion N, for example, the fixing roller 41 is depressed inward in a radial direction. The fixing device 40 fixes the unfixed toner image, transferred to the paper P, on the paper P at the fixing nip portion N where the fixing roller 41 and the nip former 50 are in contact with each other across the belt 43.

A rotating shaft (not illustrated) of the fixing roller 41 is rotatably supported by a bearing provided in a casing portion of the fixing device 40. The fixing roller 41 receives power from the fixing motor 42 (refer to FIG. 3) and rotates in the clockwise direction in FIG. 2.

The belt 43 is formed in an endless shape and is wound around a heating roller 44*a* of the heating unit 44 and the nip former 50. The belt 43 is sandwiched between the fixing roller 41 and the nip former 50 in the fixing nip portion N. The belt 43 contacts the fixing roller 41 and rotates in the counterclockwise direction in FIG. 2. The belt 43 has a length longer than the entire area in the paper width direction of the paper transport path Q. The belt 43 has a laminated structure in which an elastic layer, a release layer, and the like are provided in a base material layer including, for example, a polyimide film.

The heating unit 44 includes the heating roller 44*a* and a heater 44*b*. The heating roller 44*a* has a cylindrical shape and accommodates the heater 44*b* that heats the belt 43. The heating roller 44*a* is separated from the nip former 50 and is disposed at a position where a predetermined tension is generated on the belt 43. The axis of rotation of the heating roller 44*a* is parallel to the axis of rotation of the fixing roller 41 and extends in the paper width direction, that is, along the front-back direction of the image forming apparatus 1. The heating roller 44*a* has a length longer than the entire area in the paper width direction of the paper transport path Q. A rotating shaft (not illustrated) of the heating roller 44*a* is rotatably supported by a bearing provided in the casing portion of the fixing device 40.

The nip former 50 is disposed inside the belt 43 so as to face the fixing roller 41 and contacts the inner surface of the belt 43 to form the fixing nip portion N between the fixing roller 41 and the belt 43. The nip former 50 includes a pad 51, a pad holder 52, and a lubricant supplier 60.

The pad 51 is disposed immediately inside the fixing nip portion N of the belt 43. With respect to the paper width direction, the pad 51 has an elongated shape extending substantially in the same length as that of the belt 43. The pad 51 is pressed by the fixing roller 41 via the belt 43 and contacts the inner surface of the belt 43 in the fixing nip portion N.

The pad holder 52 is disposed in an area separated from the fixing nip portion N by the pad 51. A surface of the pad holder 52 that is on a side opposite to a side of the fixing nip portion N of the pad 51 is attached to and supports the pad 51. The pad holder 52 includes a groove-shaped metal extending in the paper width direction with a substantially U-shaped cross-sectional shape when viewed from the paper width direction. The pad holder 52 includes wall portions 52*a* and 52*b* extending in the paper width direction and toward the heating unit 44 on the upstream side and the downstream side in the rotation direction of the belt 43 with respect to the area to which the pad 51 is attached. An area of the pad holder 52 that is on the side opposite to the area to which the pad 51 is attached and that is close to the heating unit 44 is opened. The pad holder 52 is fixed to the casing portion of the fixing device 40 at both ends in the paper width direction.

Lubricant is interposed between the inner surface of the belt 43 and the pad 51 of the nip former 50. In the area of the fixing nip portion N of the pad 51, a contact pressure with the inner surface of the belt 43 is relatively high. Therefore, the lubricant may accumulate on the upstream side of the pad 51 in the rotation direction of the belt 43. The fixing device 40 includes the lubricant supplier 60 that supplies, between the inner surface of the belt 43 and the pad 51, the lubricant accumulating on the upstream side of the pad 51 in the rotation direction of the belt 43. The lubricant supplier 60 includes a sheet material 61 and a supply member 62.

The sheet material 61 is disposed to face the inner surface of the belt 43. The sheet material 61 extends from an area where the pad 51 faces the inner surface of the belt 43 to the upstream side of the pad 51 in the rotation direction of the belt 43. The sheet material 61 is fixed to the pad 51 in the area where the pad 51 faces the inner surface of the belt 43. With respect to the paper width direction, the sheet material 61 has substantially the same length as that of the belt 43. Note that the lubricant is interposed between the inner surface of the belt 43 and the surface of the sheet material 61 facing the inner surface of the belt 43.

On the upstream side of the pad 51 in the rotation direction of the belt 43, the sheet material 61 extends along the rotation direction of the belt 43 while being spaced at a predetermined interval from each of the inner surface of the belt 43 and the outer surface of the wall portion 52*a* of the pad holder 52. A lubricant-retaining space S is formed between the inner surface of the belt 43 and the sheet material 61 on the upstream side of the pad 51 in the rotation direction of the belt 43. The volume of the lubricant-retaining space S becomes larger toward the upstream in the rotation direction of the belt 43.

Herein, a surface of the sheet material 61, which faces the lubricant-retaining space S, facing the lubricant-retaining space S (lower surface in FIG. 2) is illustrated in FIG. 4. In the sheet material 61, a surface oil separation property is higher in an area 61X near the upstream end in the rotation direction of the belt 43 than in an area 61Y on the downstream side therein, among the areas of the sheet material 61 facing the lubricant-retaining space S. Specifically, a surface irregularity is smaller in the area 61X near the upstream end in the rotation direction of the belt 43 than in the area 61Y on the downstream side therein, among the areas of the sheet material 61 facing the lubricant-retaining space S. This makes it difficult for the lubricant to adhere to the area 61X of the sheet material 61.

The sheet material 61 includes a corner portion 61*a* at the upstream end in the rotation direction of the belt 43, that is, near the end of the wall portion 52*a* of the pad holder 52 adjacent to the sheet material 61. The sheet material 61 is bent at a substantially right angle toward the wall portion 52*a* of the pad holder 52 at the corner portion 61*a*.

An engaging portion 61*b* that bends toward the pad 51 is provided at a tip extending from the corner portion 61*a* of the sheet material 61 toward the open area of the pad holder 52. Herein, the sheet material 61 can swing in a direction approaching and separating from the inner surface of the belt 43 on the upstream side of the pad 51 in the rotation direction of the belt 43. When the sheet material 61 approaches the inner surface of the belt 43 of the pad 51 on the upstream side of the pad 51 in the rotation direction of the belt 43, the engaging portion 61*b* is caught by the inside of the pad holder 52 or the supply member 62. As a result, the engaging portion 61*b* blocks the upstream end in the rotation direction of the belt 43 in the area of the sheet material 61 facing the belt 43, that is, the corner portion 61*a*, from approaching the inner surface of the belt 43 beyond a predetermined distance.

The supply member 62 is provided on the inner side of the wall portion 52*a* of the pad holder 52. The supply member 62 is disposed between the inner surface of the wall portion 52*a* of the pad holder 52 and the engaging portion 61*b* of the sheet material 61. The supply member 62 includes, for example, heat-resistant silicone rubber and has a substantially flat plate shape extending in the paper width direction along the inner surface of the wall portion 52*a*. Both ends in the paper width direction of the supply member 62 are attached to the inner surface of the wall portion 52*a* by an adhesive member 63 (refer to FIG. 6) such as a double-sided tape. The supply member 62 deforms itself due to a temperature change when a fixing operation operates and when the fixing operation stops, that is, at the time of heating and at the time of non-heating by the heating unit 44.

Figure 5:
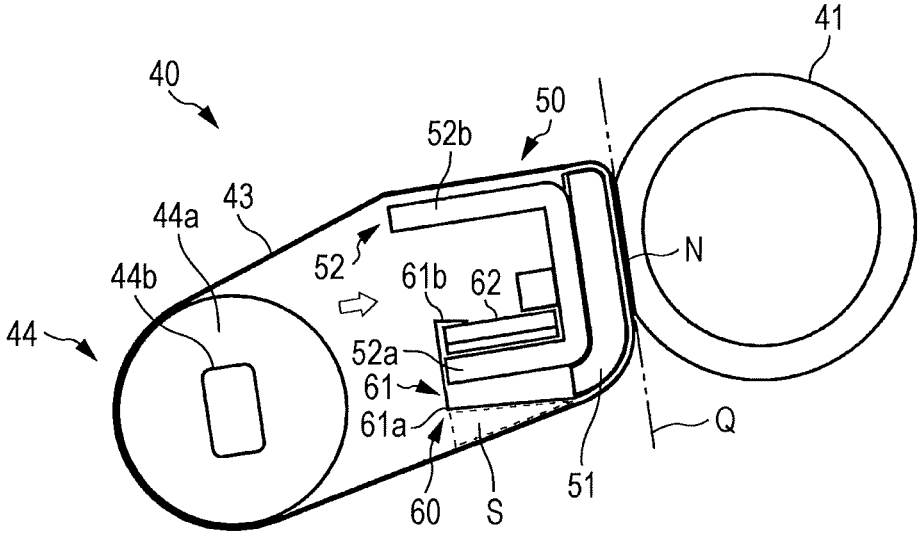
FIG. 5 is a front view of the fixing device of the image forming apparatus according to the first embodiment of the present invention, the view illustrating the fixing device being heated.
Figure 6:
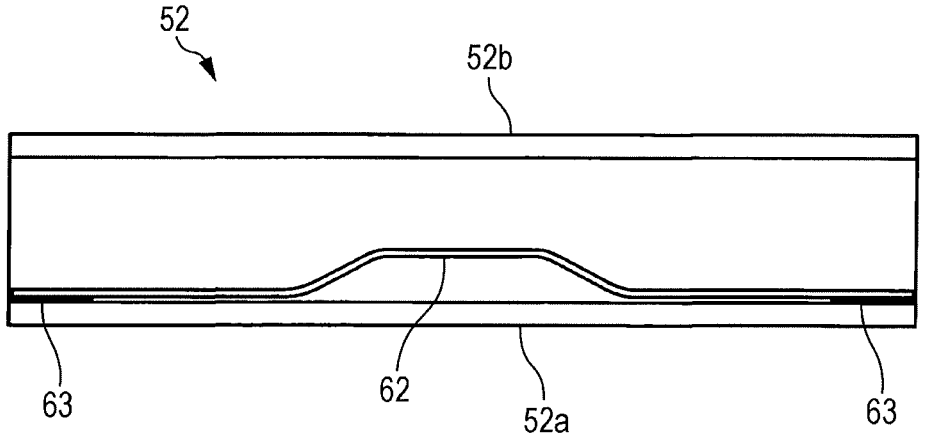
FIG. 6 is a side view illustrating the lubricant supplier of the fixing device of the image forming apparatus according to the first embodiment of the present invention.
Figure 7:
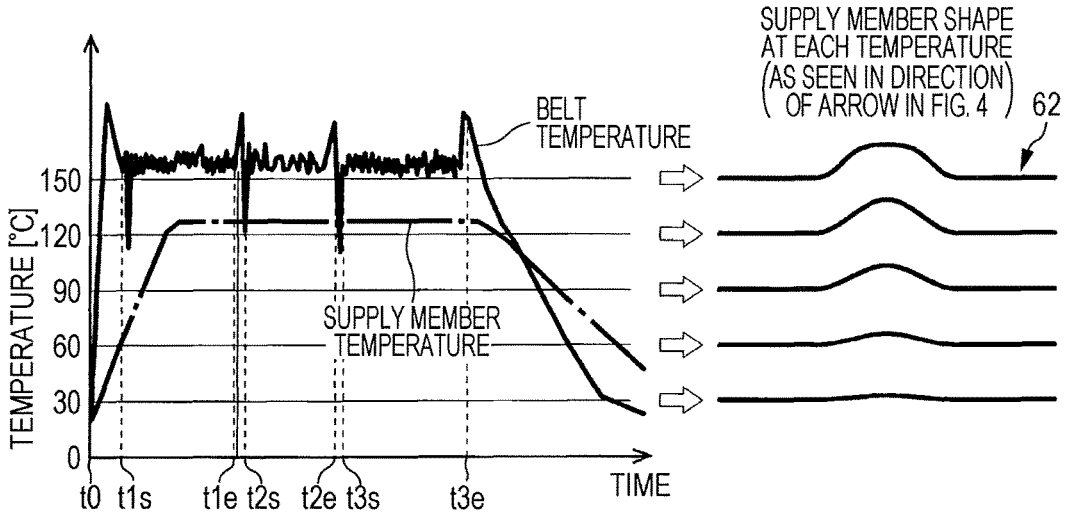
FIG. 7 is a descriptive graph illustrating a relationship between a temperature of the fixing device of the image forming apparatus and a shape of a supply member according to the first embodiment of the present invention.

Subsequently, the operation of the fixing device 40 will be described in detail with reference to FIGS. 5 to 7 in addition to FIG. 2. FIG. 5 is a front view of the fixing device 40, the view illustrating the fixing device 40 being heated. FIG. 6 is a side view illustrating the lubricant supplier 60 (as seen in the direction of an arrow in FIG. 5). FIG. 7 is a descriptive graph illustrating a relationship between a temperature of the fixing device 40 and a shape of the supply member 62.

For example, the supply member 62 forms a flat plate shape as illustrated in FIG. 2 when the fixing operation stops, that is, at the time of non-heating. The supply member 62 almost entirely contacts the inner surface of the wall portion 52*a* of the pad holder 52.

Subsequently, when the fixing operation starts and the supply member 62 is heated, the supply member 62 including the silicone rubber expands and bends as illustrated in FIGS. 5 and 6. Both ends in the paper width direction of the supply member 62 are fixed to the inner surface of the wall portion 52*a*. Therefore, the center portion in the paper width direction is curved in a direction away from the inner surface of the wall portion 52*a*.

When the center portion in the paper width direction of the supply member 62 deforms in a direction away from the inner surface of the wall portion 52*a* due to a temperature change, this deformation displaces the engaging portion 61*b* of the sheet material 61 in a direction away from the inner surface of the wall portion 52*a*, as illustrated in FIG. 5. As a result, an area of the sheet material 61 on the upstream side of the pad 51 in the rotation direction of the belt 43 is displaced in a direction away from the inner surface of the belt 43. The area includes the corner portion 61*a*. Consequently, the volume of the lubricant-retaining space S becomes larger than that when the fixing operation stops (at the time of non-heating). In this manner, the supply member 62 deforms itself due to a temperature change, thereby varying the volume of the lubricant-retaining space S. Then, the volume of the lubricant-retaining space S becomes larger when the belt is heated by the heating unit 44 than when the belt is not heated.

Next, a relationship between a temperature of the fixing device 40 and a shape of the supply member 62 will be described with reference to FIG. 7. In the graph on the left side of FIG. 7, the temperature of the belt 43 is indicated by a solid line and the temperature of the supply member 62 is indicated by a dot-and-dash line. On the right side of FIG. 7, a shape of the supply member 62 (as seen in the direction of an arrow in FIG. 5) at each temperature in increments of 30° C. is illustrated.

First, warming up of the fixing device 40 waiting at normal temperature (for example, 20° C. to 30° C.) is started (time t0 in FIG. 7). Since the belt 43 has a low thermal capacity, temperature rising thereof is relatively fast. Since the supply member 62 is not directly heated, temperature rising thereof is relatively slow.

Then, with respect to the first sheet of paper P, the toner image formed by the image forming units 20 is transferred to the paper P, and fixing is started (time t1*s* in FIG. 7). The temperature of the belt 43 abruptly decreases immediately after the sheet of paper P enters the fixing nip portion N. However, after that, the temperature of the belt 43 becomes substantially constant due to temperature control, and the fixing is continued. At this time, the temperature of the supply member 62 does not increase to the temperature of the belt 43. Note that the temperature of the fixing device 40 at the time of heating is controlled to, for example, around 200° C.

When the fixing of the first sheet of paper P is completed (time tie in FIG. 7), the paper P is discharged from the fixing nip portion N, and the temperature of the belt 43 increases. Subsequently, the second sheet of paper P enters the fixing nip portion N (time t2*s* in FIG. 7), and the above fixing process is repeated. The fixing of the second sheet of paper P is completed at time t2*e* in FIG. 7.

When the last sheet of paper P (for example, the third sheet in FIG. 7) enters the fixing nip portion N at time t3*s* in FIG. 7 and is completed (time t3*e* in FIG. 7), heating by the heating unit 44 also ends, and the temperature of the belt 43 abruptly decreases and approaches the normal temperature. Lagging behind this, the temperature of the supply member 62 also decreases.

The temperature of the belt 43 may change abruptly during the fixing process. On the other hand, since the supply member 62 has a higher heat capacity than the belt 43, a reaction to a temperature change is relatively slow. As a result, the volume of the lubricant-retaining space S does not change abruptly. The supply member 62 includes, for example, heat-resistant silicone rubber. Therefore, the supply member 62 expands thermally according to the temperature as illustrated on the right side of FIG. 7, resulting in a specific deformation amount with respect to temperature.

As in the above embodiment, in the fixing device 40, the lubricant-retaining space S is formed between the inner surface of the belt 43 and the nip former 50 on the upstream side of the nip former 50 in the rotation direction of the belt 43. In addition, the fixing device 40 is provided with the lubricant supplier 60 that varies the volume of the lubricant-retaining space S.

According to this configuration, the lubricant can be supplied between the inner surface of the belt 43 and the nip former 50 by varying the volume of the lubricant-retaining space S. This makes it possible to effectively utilize the lubricant. In order to hold an appropriate amount of the lubricant between the inner surface of the belt 43 and the nip former 50, a member that contacts the belt 43 is not newly required. This makes it possible to suppress an increase in the size of the image forming apparatus 1 and a breakage of the belt 43. Furthermore, since it is unnecessary to reversely rotate the belt 43, abrasion powder does not enter between the inner surface of the belt 43 and the nip former 50. Therefore, it is possible to reduce the size and cost of the image forming apparatus 1 and to extend the life thereof. Furthermore, it is possible to hold an appropriate amount of the lubricant between the inner surface of the belt 43 and the nip former 50, and to maintain favorable fixing properties in the image forming apparatus 1.

Furthermore, the volume of the lubricant-retaining space S is varied by utilizing a temperature difference between the time of heating and the time of non-heating of the fixing device 40. Therefore, it is possible to automatically adjust the amount of the lubricant supplied between the inner surface of the belt 43 and the nip former 50. This makes it possible to reduce the size and cost of the image forming apparatus 1.

Note that the use of the temperature difference is not limited to at the time of heating and non-heating of the fixing device 40, and heat generated in other portions of the image forming apparatus 1 may be used.

The volume of the lubricant-retaining space S is larger when the belt 43 is heated by the heating unit 44 than when the belt 43 is not heated. According to this configuration, it is possible to suppress excessive supply of the lubricant between the inner surface of the belt 43 and the nip former 50 at the time of heating. Therefore, it is possible to suppress the leakage of the lubricant from the end in the paper width direction of the belt 43 to the outside, and to prevent the malfunction of the apparatus and deterioration of the image quality caused by the malfunction. Note that at low temperature in the initial stage of the fixing operation, the lubricant is sufficiently supplied between the inner surface of the belt 43 and the nip former 50.

Furthermore, the volume of the lubricant-retaining space S becomes larger toward the upstream in the rotation direction of the belt 43. That is, the lubricant-retaining space S forms a wedge shape in which a tip of the lubricant-retaining space S becomes sharp in a direction from the upstream side in the rotation direction of the belt 43 to the downstream side therein. According to this configuration, it is possible to smoothly supply the lubricant between the inner surface of the belt 43 and the nip former 50. The capability to supply the lubricant improves, and the life of the image forming apparatus 1 can be extended.

Then, the supply member 62 of the lubricant supplier 60 deforms itself due to a temperature change of the fixing device 40, thereby varying the volume of the lubricant-retaining space S. According to this configuration, the use of the supply member 62 enables automatic adjustment of the amount of the lubricant supplied between the inner surface of the belt 43 and the nip former 50.

Furthermore, the lubricant supplier 60 includes the sheet material 61. The sheet material 61 is disposed to face the inner surface of the belt 43 and extends from an area where the nip former 50 faces the inner surface of the belt 43 to the upstream side of the nip former 50 in the rotation direction of the belt 43. According to this configuration, it is possible to smoothly supply the lubricant between the inner surface of the belt 43 and the nip former 50. The capability to supply the lubricant improves, and the life of the image forming apparatus 1 can be extended.

The sheet material 61 is fixed to the pad 51 of the nip former 50 in the area where the nip former 50 faces the inner surface of the belt 43. Therefore, it is possible to suppress the occurrences of misalignment and wrinkles of the sheet material 61 due to the rotation of the belt 43. This makes it possible to prevent the occurrence of a fixing failure.

The sheet material 61 includes the engaging portion 61*b* that blocks the corner portion 61*a*, which is the upstream end in the rotation direction of the belt 43, from approaching the inner surface of the belt 43 beyond a predetermined distance. According to this configuration, it is possible to suppress a phenomenon in which the volume of the lubricant-retaining space S becomes small unintentionally and the corner portion 61*a* of the sheet material 61 contacts the belt 43. As a result, it is possible to prevent excessive supply of the lubricant between the inner surface of the belt 43 and the nip former 50, and also to prevent the upstream portion of the sheet material 61 in the belt rotation direction from being caught between the inner surface of the belt 43 and the nip former 50.

Furthermore, as illustrated in FIG. 4, in the sheet material 61, the surface oil separation property is higher in the area 61X near the upstream end in the rotation direction of the belt 43 than in the area 61Y on the downstream side therein, among the areas facing the lubricant-retaining space S. More specifically, a surface irregularity is smaller in the area 61X than in the area 61Y. According to this configuration, in the lubricant-retaining space S, the lubricant becomes less likely to accumulate in the upstream end part in the belt rotation direction than in the downstream part therein. Therefore, it becomes easy to supply the lubricant toward between the inner surface of the belt 43 and the nip former 50, and it is possible to improve the capability to supply the lubricant. That is, the life of the image forming apparatus 1 can be extended.

Second Embodiment

Figure 8:
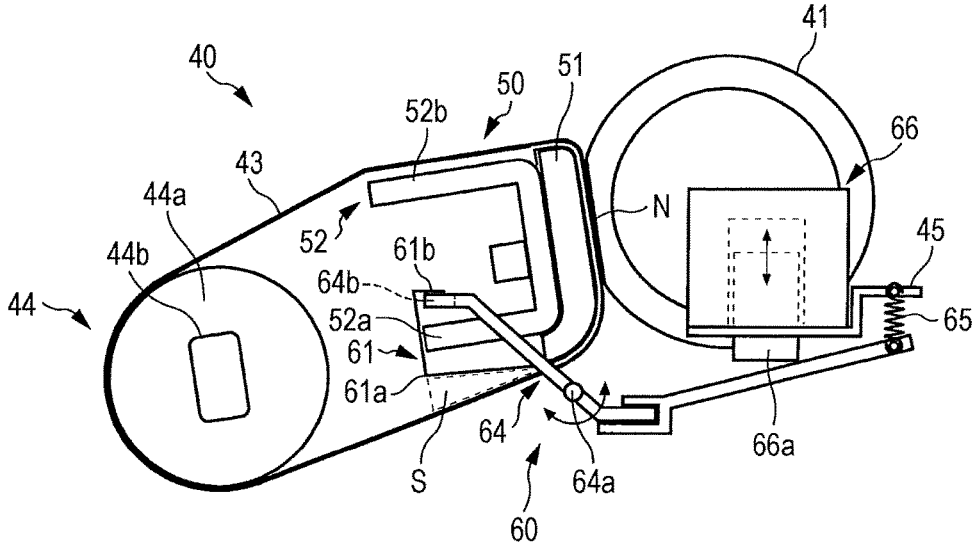
FIG. 8 is a front view of a fixing device of an image forming apparatus according to a second embodiment of the present invention.

Next, an image forming apparatus according to a second embodiment of the present invention will be described with reference to FIG. 8. FIG. 8 is a front view of a fixing device of the image forming apparatus. Note that since the basic configuration of this embodiment is the same as that of the first embodiment described above, the same names and reference numerals as those in the first embodiment are given to the same constituent components as those in the first embodiment, and the detailed description thereof may be omitted.

In the fixing device 40 of the image forming apparatus 1 of the second embodiment, a lubricant supplier 60 illustrated in FIG. 8 includes a lever 64, a biasing member 65, and a solenoid 66 that is a supply member.

The lever 64 is disposed outside a belt 43, a pad 51, a pad holder 52, and a sheet material 61 in the paper width direction. For example, the lever 64 extends along a direction in which a fixing roller 41 and a nip former 50 face each other. The lever 64 is rotatably supported by a casing portion of the fixing device 40 via a support shaft 64*a* extending in the paper width direction. The lever 64 is rotatable in the clockwise direction or in the counterclockwise direction in FIG. 8 around the axis of the support shaft 64*a*.

One end of the lever 64 is positioned immediately outside an engaging portion 61*b* of the sheet material 61 in the paper width direction. A contact portion 64*b* is provided at the one end of the lever 64. The contact portion 64*b* is disposed between the inner surface of a wall portion 52*a* of the pad holder 52 and the engaging portion 61*b* of the sheet material 61. The contact portion 64*b* extends over the entire area in the paper width direction of the sheet material 61.

The biasing member 65 is disposed at one end of the lever 64 opposite to the contact portion 64*b*. The biasing member 65 includes, for example, a tension spring, and both ends of the biasing member 65 are connected between the end portion of the lever 64 and a casing portion 45 of the fixing device 40. The biasing member 65 biases the lever 64 in a direction to rotate the lever 64 in the counterclockwise direction in FIG. 8.

The solenoid 66 is adjacent to the lever 64 and is disposed between the support shaft 64*a* and the end of the lever 64 at which the biasing member 65 is disposed. The solenoid 66 is configured as a pull type in which a movable iron core 66*a* is retracted when the power supply is turned on (when energized). The solenoid 66 is disposed at a position where the movable iron core 66*a* contacts the lever 64 and rotates the lever 64 in the clockwise direction in FIG. 8 against a biasing force of the biasing member 65. When the solenoid 66 is turned on, the movable iron core 66*a* is retracted, and the lever 64 rotates in the counterclockwise direction in FIG. 8 by the biasing force of the biasing member 65.

Normally, the solenoid 66 is turned off, and the lever 64 rotates in the clockwise direction in FIG. 8 against the biasing force of the biasing member 65. The lever 64 is displaced in a direction in which the contact portion 64*b* separates from the inner surface of the wall portion 52*a*. This displacement displaces the engaging portion 61*b* of the sheet material 61 in a direction away from the inner surface of the wall portion 52*a*. As a result, an area of the sheet material 61 on the upstream side of the pad 51 in the rotation direction of the belt 43 is displaced in a direction away from the inner surface of the belt 43. The area includes a corner portion 61*a*. Consequently, the volume of a lubricant-retaining space S becomes relatively large.

Then, the lubricant supplier 60 varies the volume of the lubricant-retaining space S, according to the number of times of fixing operations.

For example, every time 5000 sheets of the paper P are printed, the lubricant supplier 60 turns on the solenoid 66 for several seconds. The lever 64 rotates in the counterclockwise direction in FIG. 8 by the biasing force of the biasing member 65, and the contact portion 64*b* is displaced in the direction approaching the inner surface of the wall portion 52*a*. This displacement displaces the engaging portion 61*b* of the sheet material 61 in a direction approaching the inner surface of the wall portion 52*a*. As a result, an area of the sheet material 61 on the upstream side of the pad 51 in the rotation direction of the belt 43 is displaced in a direction approaching the inner surface of the belt 43. The area includes the corner portion 61*a*. Consequently, the volume of the lubricant-retaining space S becomes relatively small. Therefore, it becomes easy to supply the lubricant toward between the inner surface of the belt 43 and the nip former 50.

According to the configuration of the second embodiment, the lubricant can be supplied toward between the inner surface of the belt 43 and the nip former 50 each time a predetermined number of sheets are printed, that is, at a predetermined operation timing. As a result, it is possible to extend the life of the image forming apparatus 1 by operating the lubricant supplier 60 to the minimum necessary extent.

Third Embodiment

Figure 9:
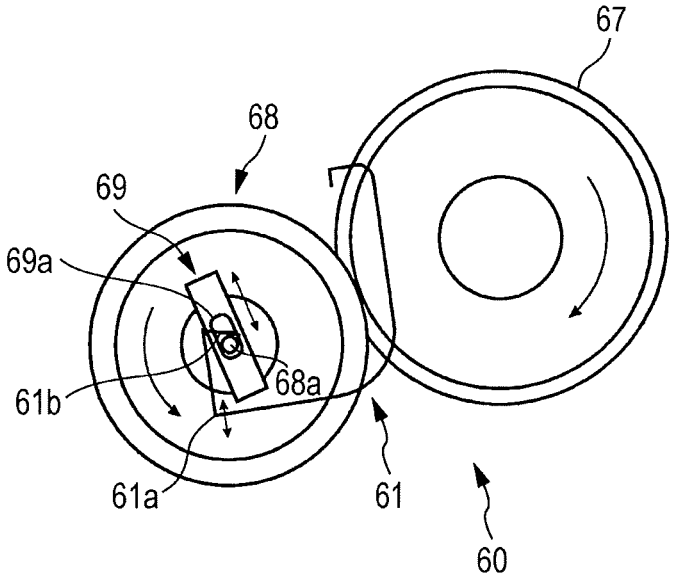
FIG. 9 is a front view of a fixing device of an image forming apparatus according to a third embodiment of the present invention.

Next, an image forming apparatus according to a third embodiment of the present invention will be described with reference to FIG. 9. FIG. 9 is a front view of a fixing device of the image forming apparatus. Note that since the basic configuration of this embodiment is the same as that of the first embodiment described above, the same names and reference numerals as those in the first embodiment are given to the same constituent components as those in the first embodiment, and the detailed description thereof may be omitted.

In the fixing device 40 of the image forming apparatus 1 according to the third embodiment, a lubricant supplier 60 illustrated in FIG. 9 includes a fixing roller gear 67, a swing gear 68 that is a supply member, and a guide member 69. Note that for convenience of description, drawing of some constituent components of the fixing device 40 is omitted in FIG. 9.

The fixing roller gear 67 rotates in conjunction with the rotation of a fixing roller 41. The fixing roller gear 67 may be a gear itself that rotates the fixing roller 41 or may be separately provided as a constituent component of the lubricant supplier 60.

The swing gear 68 is connected so as to engage with the fixing roller gear 67. The swing gear 68 includes a rotating shaft 68*a* extending in the paper width direction. The rotating shaft 68*a* is supported by the guide member 69. The rotating shaft 68*a* is disposed between the inner surface of a wall portion 52*a* of a pad holder 52 and an engaging portion 61*b* of a sheet material 61.

The guide member 69 is disposed outside the sheet material 61 in the paper width direction. The guide member 69 includes a guide groove 69*a* including an elongate hole extending in the radial direction of the swing gear 68 while crossing the paper width direction. The rotating shaft 68*a* of the swing gear 68 is inserted into the guide groove 69*a*. As a result, the swing gear 68 can move along the direction in which the guide groove 69*a* including the elongate hole extends.

When fixing by the fixing device 40 is started, the fixing roller 41 and the fixing roller gear 67 rotate in the clockwise direction in FIG. 9. The swing gear 68 rotates in the counterclockwise direction in FIG. 9. This rotational force causes the rotating shaft 68*a* of the swing gear 68 to move upward in FIG. 9 along the guide groove 69*a* of the guide member 69. The rotating shaft 68*a* of the swing gear 68 displaces the engaging portion 61*b* of the sheet material 61 in a direction away from the inner surface of the wall portion 52*a*. As a result, an area of the sheet material 61 on the upstream side of the pad 51 in the rotation direction of the belt 43 is displaced in a direction away from the inner surface of the belt 43. The area includes the corner portion 61*a*. Consequently, the volume of a lubricant-retaining space S becomes relatively large.

When the rotation of the fixing roller 41 is stopped, the rotation of the swing gear 68 is also stopped. The action of gravity acts on the swing gear 68, and the rotating shaft 68*a* moves downward in FIG. 9 along the guide groove 69*a* of the guide member 69. The rotating shaft 68*a* of the swing gear 68 displaces the engaging portion 61*b* of the sheet material 61 in a direction approaching the inner surface of the wall portion 52*a*. As a result, an area of the sheet material 61 on the upstream side of the pad 51 in the rotation direction of the belt 43 is displaced in a direction approaching the inner surface of the belt 43. The area includes the corner portion 61*a*. Consequently, the volume of the lubricant-retaining space S becomes relatively small.

As described above, according to the configuration of the third embodiment, the lubricant supplier 60 varies the volume of the lubricant-retaining space S in conjunction with the rotation operation of the fixing roller 41. Therefore, the lubricant can be supplied automatically between the inner surface of the belt 43 and the nip former 50 without performing special control. That is, the life of the image forming apparatus 1 can be extended.

Fourth Embodiment

Figure 10:
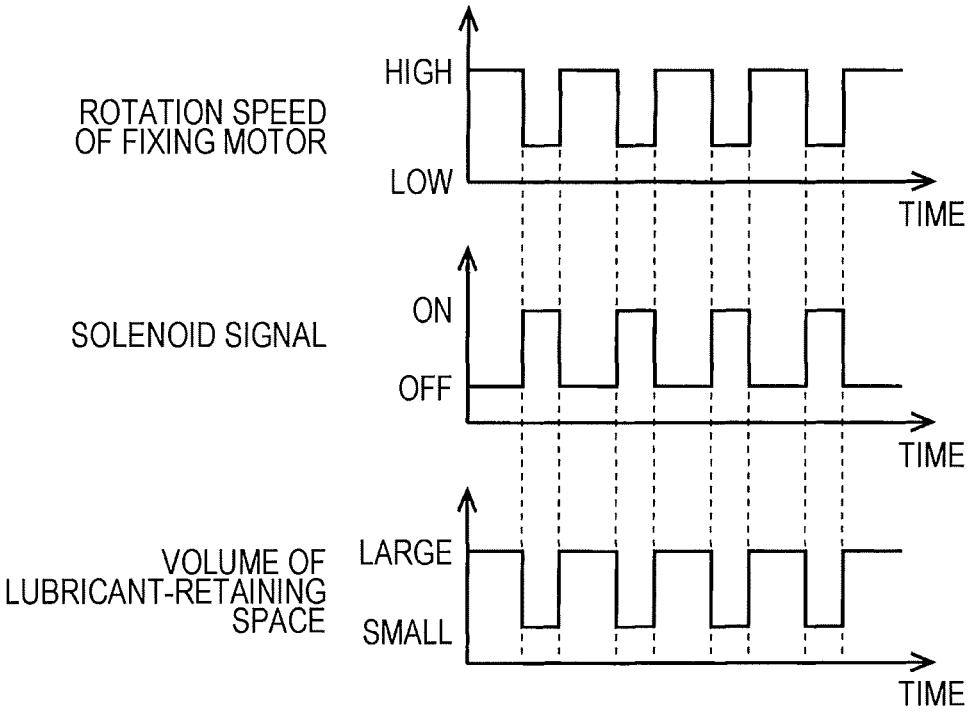
FIG. 10 is a timing chart of a fixing device of an image forming apparatus according to a fourth embodiment of the present invention.

Next, an image forming apparatus according to a fourth embodiment of the present invention will be described with reference to FIG. 10. FIG. 10 is a timing chart of a fixing device of the image forming apparatus. Note that since the basic configuration of this embodiment is the same as those of the first embodiment and the second embodiment (FIG. 8) described above, the same names and reference numerals as those in the first embodiment and the second embodiment are given to the same constituent components as those in the embodiments, and the detailed description thereof may be omitted.

For example, in a color copying machine, the transport speed of paper P may vary in a section from a secondary transfer nip portion to a fixing nip portion N. Causes of the variation in the transport speed of the paper P include a change in the diameter of a fixing roller 41 due to thermal expansion and durability deterioration, a change in a slip ratio for each image pattern, and the like. Accordingly, by adjusting the rotation speed of the fixing roller 41, elongation of an image caused by pulling of the paper P and toner dropping (and peripheral stains) caused by excessive bending of the paper P are prevented.

The rotation speed of a belt 43 increases or decreases in conjunction with the rotation speed of the fixing roller 41. When the rotation speed of the belt 43 is relatively high, a film of lubricant is easily formed between the inner surface of the belt 43 and a nip former 50. When the rotation speed of the belt 43 is relatively low, the film of the lubricant is not easily formed between the inner surface of the belt 43 and the nip former 50.

Therefore, the fixing device 40 of the image forming apparatus 1 according to the fourth embodiment achieves fixing operations at timings in the timing chart illustrated in FIG. 10. FIG. 10 illustrates timings relating to the rotation speed of a fixing motor 42, the signal of a solenoid 66 (refer to FIG. 8), and the volume of a lubricant-retaining space S.

According to FIG. 10, in the fixing device 40, when the rotation speed of the fixing motor 42 is decreased, a lubricant supplier 60 turns on the solenoid 66. As a result, the volume of the lubricant-retaining space S becomes relatively small. Therefore, it becomes easy to supply the lubricant toward between the inner surface of the belt 43 and the nip former 50.

On the other hand, in the fixing device 40, when the rotation speed of the fixing motor 42 is increased, the lubricant supplier 60 turns off the solenoid 66. As a result, the volume of the lubricant-retaining space S becomes relatively large. Therefore, the amount of the lubricant supplied between the inner surface of the belt 43 and the nip former 50 decreases and a favorable film of the lubricant is formed. Furthermore, torque is no longer generated more than necessary.

As described above, according to the configuration of the fourth embodiment, the lubricant supplier 60 varies the volume of the lubricant-retaining space S in conjunction with the change operation of the rotation speed of the fixing roller 41. Therefore, it is possible to vary the amount of the lubricant supplied between the inner surface of the belt 43 and the nip former 50 according to the rotation speed of the belt 43. Therefore, it is possible to achieve the favorable supply of lubricant according to the fixing operation.

Fifth Embodiment

Figure 11:
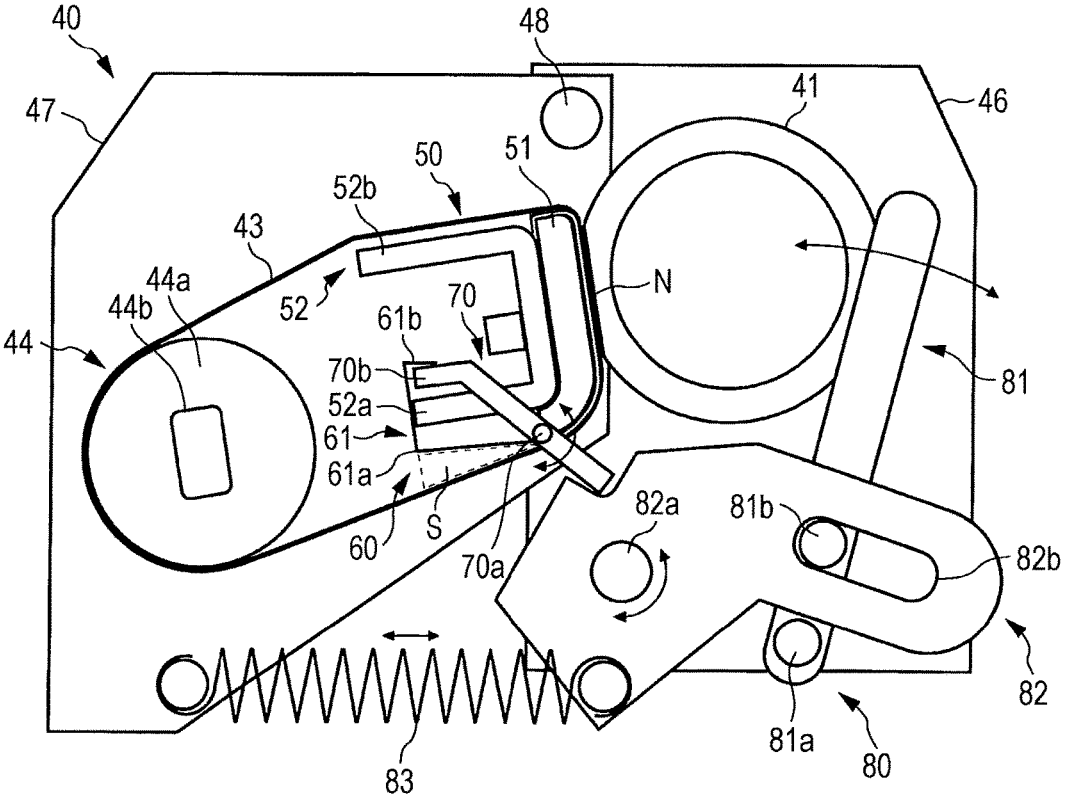
FIG. 11 is a front view of a fixing device of an image forming apparatus according to a fifth embodiment of the present invention.

Next, an image forming apparatus according to a fifth embodiment of the present invention will be described with reference to FIG. 11. FIG. 11 is a front view of a fixing device of the image forming apparatus. Note that since the basic configuration of this embodiment is the same as that of the first embodiment described above, the same names and reference numerals as those in the first embodiment are given to the same constituent components as those in the first embodiment, and the detailed description thereof may be omitted.

The fixing device 40 of the image forming apparatus 1 of the fifth embodiment includes a pressure mechanism 80 illustrated in FIG. 11. The pressure mechanism 80 is provided with a pressure lever 81, a link member 82, and a pressure spring 83. A lubricant supplier 60 includes a lever 70.

Herein, the fixing device 40 is provided with side plates 46 and 47 extending along the vertical direction and the horizontal direction in FIG. 11. The side plates 46 and 47 are disposed on both ends in the paper width direction of a fixing roller 41, a belt 43, a heating unit 44, and a nip former 50, that is, on the front side and the back side of the fixing device 40. The side plate 46 rotatably supports the fixing roller 41 via a bearing (not illustrated). The side plate 47 rotatably supports a heating roller 44*a* of the heating unit 44 via a bearing (not illustrated). Furthermore, the side plate 47 supports a pad holder 52 of the nip former 50.

The side plates 46 and 47 are connected to each other by a connecting unit 48. The connecting unit 48 is disposed between the side plates 46 and 47 and positioned above a fixing nip portion N. The connecting unit 48 has a shaft portion extending along the paper width direction. The side plate 46 is supported by the side plate 47 while being rotatable around the axis of the connecting unit 48. By rotating the lower side of the side plate 46 around the axis of the connecting unit 48, the fixing nip portion N can be formed or released.

The pressure lever 81 extends in the vertical direction in FIG. 11. The lower end of the pressure lever 81, positioned below the fixing roller 41, is rotatably supported by the side plate 46 of the fixing device 40 via a rotating shaft 81*a* extending in the paper width direction. The upper end of the pressure lever 81 is a free end and can be gripped by a user, for example. A pin 81*b* is provided at a position that is near the rotating shaft 81*a* of the pressure lever 81 and near the upper end. The pin 81*b* of the pressure lever 81 protrudes in the paper width direction and engages with the link member 82.

The link member 82 extends in the horizontal direction in FIG. 11. One end of the link member 82, positioned below the fixing nip portion N, is rotatably supported by the side plate 46 of the fixing device 40 via a rotating shaft 82*a* extending in the paper width direction. On the other end of the link member 82, there is provided a guide groove 82*b* including an elongate hole extending in the horizontal direction in FIG. 11 while crossing the paper width direction. The guide groove 82*b* is disposed adjacent to the pressure lever 81, and the pin 81*b* of the pressure lever 81 is inserted into the guide groove 82*b*. As a result, the link member 82 rotates around the axis of the rotating shaft 82*a* in conjunction with the rotation operation about the axis of the rotating shaft 81*a* of the pressure lever 81.

The pressure spring 83 is disposed in the lower part of the fixing device 40 such that the pressure spring 83 is positioned across the fixing nip portion N from the connecting unit 48. The pressure spring 83 includes, for example, a tension spring, and both ends of the pressure spring 83 are connected between the lower side of the rotating shaft 82*a* of the link member 82 and the lower part of the side plate 47. The pressure spring 83 biases the side plate 46 in the direction of rotating in the clockwise direction in FIG. 11 around the axis of the connecting unit 48.

In FIG. 11, when the upper end side of the pressure lever 81 is displaced in a direction approaching the fixing nip portion N, the link member 82 rotates counterclockwise. As a result, the end of the pressure spring 83 on a side of the link member 82 is displaced in a direction away from a side of the side plate 47 against the elastic force of the pressure spring 83. Consequently, the peripheral surface of the fixing roller 41 presses and contacts the peripheral surface of the belt 43 to form the fixing nip portion N.

The lever 70 is disposed outside the belt 43, the pad 51, the pad holder 52, and the sheet material 61 in the paper width direction and adjacent to the link member 82. The lever 70 extends from immediately outside an engaging portion 61*b* of the sheet material 61 in the paper width direction to a position close to the link member 82. The lever 70 is rotatably supported by a casing portion of the fixing device 40 via a support shaft 70*a* extending in the paper width direction. The lever 70 is rotatable in the clockwise direction or in the counterclockwise direction in FIG. 11 around the axis of the support shaft 70*a*.

The lever 70 includes a contact portion 70*b* at one end on a side of the engaging portion 61*b* of the sheet material 61.

The contact portion 70*b* is disposed between the inner surface of a wall portion 52*a* of the pad holder 52 and the engaging portion 61*b* of the sheet material 61. The contact portion 70*b* extends over the entire area in the paper width direction of the sheet material 61. One end of the lever 70 opposite to the contact portion 70*b* contacts the link member 82.

Normally, the elastic force of the pressure spring 83 is used to form the fixing nip portion N between the peripheral surface of the fixing roller 41 and the peripheral surface of the belt 43. Therefore, the link member 82 rotates in the counterclockwise direction in FIG. 11. The lever 70 rotates in the clockwise direction in FIG. 11. The lever 70 is displaced in a direction in which the contact portion 70*b* separates from the inner surface of the wall portion 52*a*. This displacement displaces the engaging portion 61*b* of the sheet material 61 in a direction away from the inner surface of the wall portion 52*a*. As a result, an area of the sheet material 61 on the upstream side of the pad 51 in the rotation direction of the belt 43 is displaced in a direction away from the inner surface of the belt 43. The area includes the corner portion 61*a*. Consequently, the volume of a lubricant-retaining space S becomes relatively large.

On the other hand, when the pressure lever 81 is rotated in the clockwise direction in FIG. 11 in order to separate the peripheral surface of the fixing roller 41 from the peripheral surface of the belt 43, the link member 82 is rotated in the clockwise direction in FIG. 11. The lever 70 rotates in the counterclockwise direction in FIG. 11. The lever 70 is displaced in a direction in which the contact portion 70*b* approaches the inner surface of the wall portion 52*a*. This displacement displaces the engaging portion 61*b* of the sheet material 61 in a direction approaching the inner surface of the wall portion 52*a*. As a result, an area of the sheet material 61 on the upstream side of the pad 51 in the rotation direction of the belt 43 is displaced in a direction away from the inner surface of the belt 43. The area includes the corner portion 61*a*. Consequently, the volume of the lubricant-retaining space S becomes relatively small.

As described above, according to the configuration of the fifth embodiment, the image forming apparatus 1 includes the pressure mechanism 80 that brings the fixing roller 41 and the belt 43 into and out of contact with each other, and the lubricant supplier 60 varies the volume of the lubricant-retaining space S, in conjunction with the operation of the pressure mechanism 80. The operation of bringing the fixing roller 41 and the belt 43 into and out of contact with each other is performed before and after the operation of the fixing device 40 or when a paper jam occurs. That is, it is possible to change the volume of the lubricant-retaining space S at very little frequency. Therefore, it is possible to supply the lubricant toward between the inner surface of the belt 43 and the nip former 50 a further fewer number of times, and to extend the life of the image forming apparatus 1.

Sixth Embodiment

Figure 12:
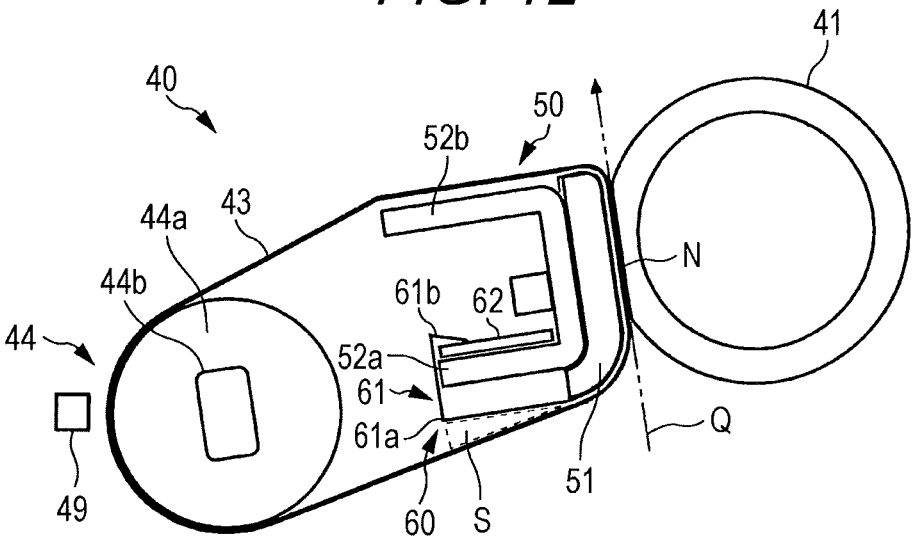
FIG. 12 is a front view of a fixing device of an image forming apparatus according to a sixth embodiment of the present invention.

Next, an image forming apparatus according to a sixth embodiment of the present invention will be described with reference to FIG. 12. FIG. 12 is a front view of a fixing device of the image forming apparatus. Note that since the basic configuration of this embodiment is the same as those of the first embodiment and the second embodiment (FIG. 8) described above, the same names and reference numerals as those in the first embodiment and the second embodiment are given to the same constituent components as those in the embodiments, and the detailed description thereof may be omitted.

The fixing device 40 of the image forming apparatus 1 of the sixth embodiment includes a temperature detector 49 illustrated in FIG. 12. The temperature detector 49 is disposed close to a heating unit 44 and outside the peripheral surface of a belt 43. The temperature detector 49 detects the temperature of the belt 43.

Then, a lubricant supplier 60 varies the volume of a lubricant-retaining space S, on the basis of the temperature detected by the temperature detector 49. For example, a solenoid 66 (refer to FIG. 8) is used for the lubricant supplier 60 in order to vary the volume of the lubricant-retaining space S.

For example, in a case where the temperature of the belt 43 is higher than a predetermined temperature, the lubricant supplier 60 increases the volume of the lubricant-retaining space S in comparison with a case where the temperature of the belt 43 is lower than the predetermined temperature. According to this configuration, it is possible to suppress excessive supply of the lubricant between the inner surface of the belt 43 and the nip former 50 at the time of heating. Therefore, it is possible to prevent the lubricant from leaking to the outside from the end of the belt 43 in the paper width direction, and to prevent malfunction of the apparatus and deterioration of the image quality caused by the malfunction.

On the other hand, in the case where the temperature of the belt 43 is lower than the predetermined temperature, the lubricant supplier 60 decreases the volume of the lubricant-retaining space S in comparison with the case where the temperature of the belt 43 is higher than the predetermined temperature. According to this configuration, in a state where the temperature of the belt 43 is relatively low, the lubricant can be sufficiently supplied between the inner surface of the belt 43 and the nip former 50.

Seventh Embodiment

Figure 13:
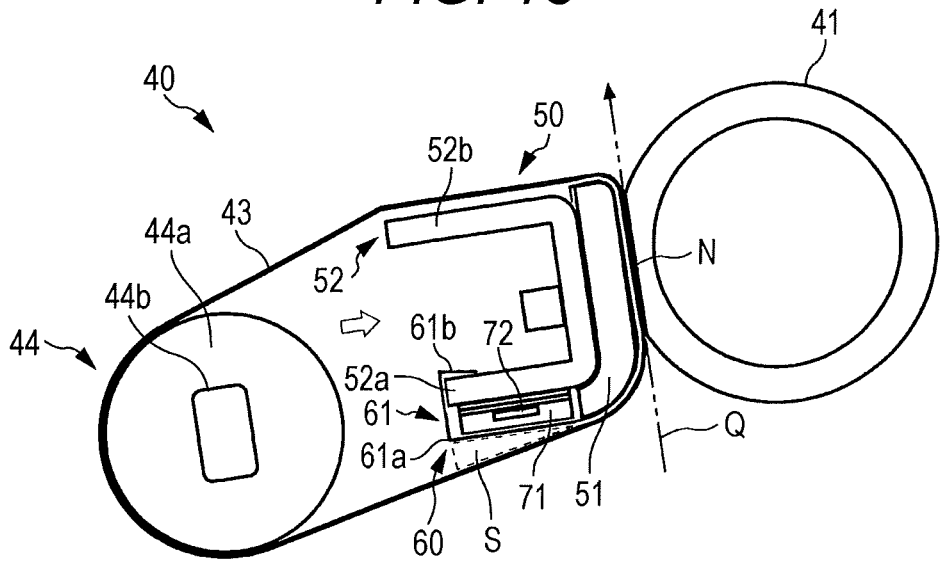
FIG. 13 is a front view of a fixing device of an image forming apparatus according to a seventh embodiment of the present invention.
Figure 14:
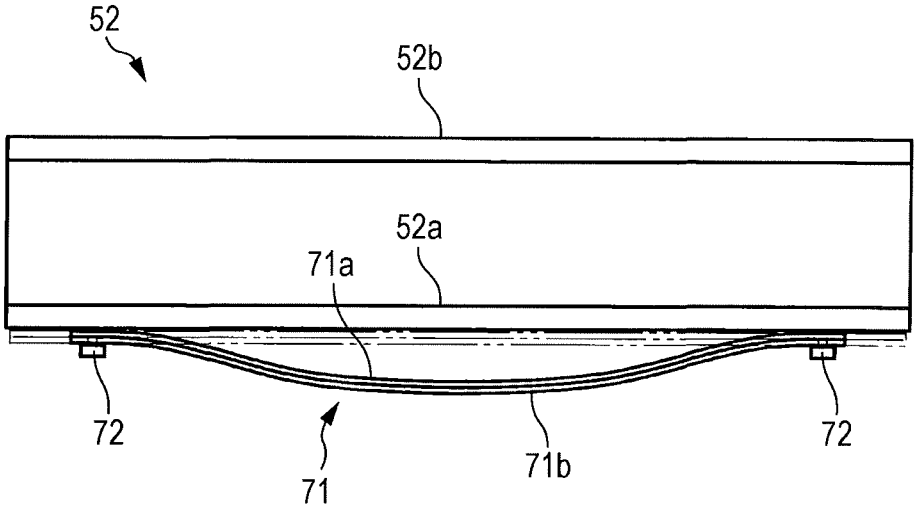
FIG. 14 is a side view illustrating a lubricant supplier of the fixing device of the image forming apparatus according to the seventh embodiment of the present invention.

Next, an image forming apparatus according to a seventh embodiment of the present invention will be described with reference to FIGS. 13 and 14. FIG. 13 is a front view of a fixing device of the image forming apparatus. FIG. 14 is a side view illustrating a lubricant supplier of the fixing device (as seen in the direction of an arrow in FIG. 13). Note that since the basic configuration of this embodiment is the same as that of the first embodiment described above, the same names and reference numerals as those in the first embodiment are given to the same constituent components as those in the first embodiment, and the detailed description thereof may be omitted.

In the fixing device 40 of the image forming apparatus 1 according to the seventh embodiment, the lubricant supplier 60 illustrated in FIGS. 13 and 14 includes a supply member 71.

The supply member 71 is disposed to face a surface of a sheet material 61 opposite to a surface facing the inner surface of a belt 43 in an area on the upstream side of a nip former 50 in the rotation direction of the belt 43. Specifically, the supply member 71 is provided outside a wall portion 52*a* of a pad holder 52. The supply member 71 is disposed between the outer surface of the wall portion 52*a* of the pad holder 52 and a surface of the sheet material 61 on the side of the wall portion 52*a*.

The supply member 71 is of, for example, bimetal including two materials having different coefficients of thermal expansion, and forms a substantially plate shape extending in the paper width direction along the outer surface of the wall portion 52*a*. Both ends of the supply member 71 in the paper width direction are attached to the outer surface of the wall portion 52*a* by, for example, locking members 72 such as a screw. Note that in consideration of deformation of the supply member 71 itself, the supply member 71 may be provided with an elongate hole extending in the paper width direction and the locking member 72 may be inserted into the elongate hole, thereby allowing the supply member 71 to slightly move in the paper width direction. The supply member 71 deforms itself due to a temperature change when a fixing operation operates and when the fixing operation stops, that is, at the time of heating and at the time of non-heating by the heating unit 44.

For example, when the fixing operation stops, that is, at the time of non-heating, the supply member 71 is curved such that the center portion in the paper width direction illustrated in FIGS. 13 and 14 is separated from the outer surface of the wall portion 52*a*. Herein, the supply member 71 includes the bimetal. The first surface side of the supply member 71, which is adjacent to the wall portion 52*a*, includes a high expansion material 71*a*. The second surface side of the supply member 71, which is opposite to the first surface side that includes the high expansion material 71*a*, includes a low expansion material 71*b*.

Subsequently, when the fixing operation starts and the supply member 71 is heated, the supply member 71 including the bimetal deforms into a flat plate shape due to the expansion of the high expansion material 71*a* as illustrated by the two-dot chain line in FIG. 14. The supply member 71 almost entirely contacts the outer surface of the wall portion 52*a* of the pad holder 52.

When the center portion in the paper width direction of the supply member 71 deforms in a direction coming in contact with the outer surface of the wall portion 52*a* due to the temperature change, this deformation displaces the engaging portion 61*b* of the sheet material 61 in a direction away from the inner surface of the wall portion 52*a*. As a result, an area of the sheet material 61 on the upstream side of the pad 51 in the rotation direction of the belt 43 is displaced in a direction away from the inner surface of the belt 43. The area includes the corner portion 61*a*. Consequently, the volume of the lubricant-retaining space S becomes larger than that when the fixing operation stops (at the time of non-heating). In this manner, the supply member 71 deforms itself due to a temperature change, thereby varying the volume of the lubricant-retaining space S. Then, the volume of the lubricant-retaining space S becomes larger when the belt is heated by the heating unit 44 than when the belt is not heated.

According to the configuration of the seventh embodiment, it is possible to vary the volume of the lubricant-retaining space S by using the supply member 71 that is a relatively thin and highly versatile functional member. Therefore, it is possible to reduce the size and cost of the image forming apparatus 1.

Eighth Embodiment

Figure 15:
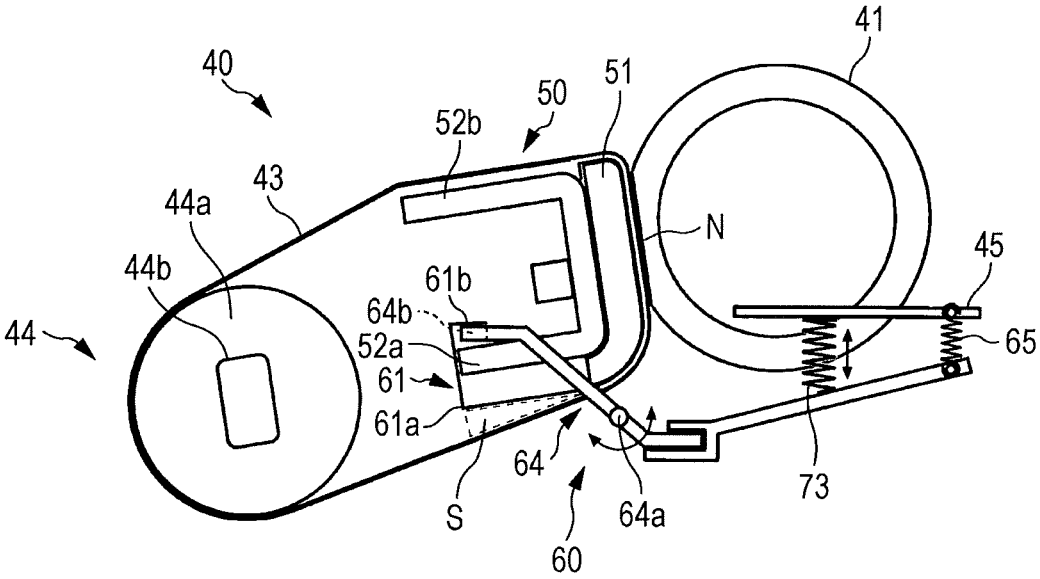
FIG. 15 is a front view of a fixing device of an image forming apparatus according to an eighth embodiment of the present invention.

Next, an image forming apparatus according to an eighth embodiment of the present invention will be described with reference to FIG. 15. FIG. 15 is a front view of a fixing device of the image forming apparatus. Note that since the basic configuration of this embodiment is the same as those of the first embodiment and the second embodiment (FIG. 8) described above, the same names and reference numerals as those in the first embodiment and the second embodiment are given to the same constituent components as those in the embodiments, and the detailed description thereof may be omitted.

In the fixing device 40 of the image forming apparatus 1 according to the eighth embodiment, a lubricant supplier 60 illustrated in FIG. 15 includes a lever 64, a biasing member 65, and a shape memory alloy spring 73 that is a supply member.

The shape memory alloy spring 73 is adjacent to the lever 64 and is disposed between a support shaft 64*a* and the end of the lever 64 at which the biasing member 65 is disposed. The shape memory alloy spring 73 is formed into a spring shape with a shape memory alloy and both ends thereof are disposed so as to be sandwiched between the lever 64 and a casing portion 45 of the fixing device 40. The shape memory alloy spring 73 expands, contracts, and deforms itself due to a temperature change when a fixing operation operates and when the fixing operation stops, that is, at the time of heating and at the time of non-heating by a heating unit 44.

For example, the shape memory alloy spring 73 forms a contracted shape as illustrated in FIG. 15 when the fixing operation stops, that is, at the time of non-heating. Subsequently, when the fixing operation starts and the shape memory alloy spring 73 is heated, the shape memory alloy spring 73 deforms into a more elongated shape than when the shape memory alloy spring 73 is not heated.

The shape memory alloy spring 73 expands, thereby displacing an engaging portion 61*b* of a sheet material 61 in a direction away from the inner surface of a wall portion 52*a*. As a result, an area of the sheet material 61 on the upstream side of the pad 51 in the rotation direction of the belt 43 is displaced in a direction away from the inner surface of the belt 43. The area includes the corner portion 61*a*. Consequently, the volume of the lubricant-retaining space S becomes larger than that when the fixing operation stops (at the time of non-heating). In this manner, the shape memory alloy spring 73 deforms itself due to a temperature change, thereby varying the volume of the lubricant-retaining space S. Then, the volume of the lubricant-retaining space S becomes larger when the belt is heated by the heating unit 44 than when the belt is not heated.

According to the configuration of the eighth embodiment, it is possible to vary the volume of the lubricant-retaining space S by using the shape memory alloy spring 73 that is a relatively small and highly versatile functional member. Therefore, it is possible to reduce the size and cost of the image forming apparatus 1.

Ninth Embodiment

Figure 16:
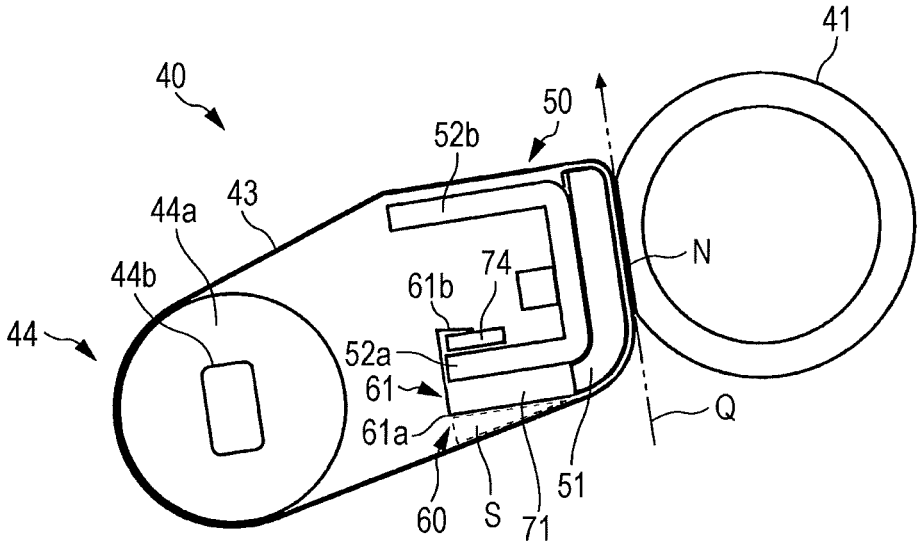
FIG. 16 is a front view of a fixing device of an image forming apparatus according to a ninth embodiment of the present invention.

Next, an image forming apparatus according to a ninth embodiment of the present invention will be described with reference to FIG. 16. FIG. 16 is a front view of a fixing device of the image forming apparatus. Note that since the basic configuration of this embodiment is the same as those of the first embodiment and the second embodiment (FIG. 8) described above, the same names and reference numerals as those in the first embodiment and the second embodiment are given to the same constituent components as those in the embodiments, and the detailed description thereof may be omitted.

In the fixing device 40 of the image forming apparatus 1 of the ninth embodiment, a lubricant supplier 60 illustrated in FIG. 16 includes an elastic container 74 that is a supply member.

The elastic container 74 is provided on the inner side of a wall portion 52*a* of a pad holder 52. The elastic container 74 is disposed between the inner surface of the wall portion 52*a* of the pad holder 52 and an engaging portion 61*b* of a sheet material 61. One elastic container 74 is provided at the center portion in the paper width direction of the sheet material 61, or three elastic containers 74 including those provided at both ends in the paper width direction are provided.

The elastic container 74 is a so-called vacuum chamber used for, for example, a barometer and an altimeter. The elastic container 74 includes a container the interior of which is vacuum and hermetically sealed and the exterior of which elastically deforms. Note that the term "vacuum" includes a state in which the pressure is lower than the atmospheric pressure, and is not limited to a strictly vacuum state. The elastic container 74 is formed into a cylindrical shape having, for example, a diameter of 10 mm to 20 mm and a thickness of about 5 mm. The elastic container 74 expands, contracts, and deforms itself due to a temperature change when a fixing operation operates and when the fixing operation stops, that is, at the time of heating and at the time of non-heating by a heating unit 44.

For example, the elastic container 74 forms a contracted shape illustrated in FIG. 16 when the fixing operation stops, that is, at the time of non-heating. Subsequently, when the fixing operation starts and the elastic container 74 is heated, the elastic container 74 deforms into a more expanded shape than when the elastic container 74 is not heated.

The elastic container 74 expands, thereby displacing the engaging portion 61*b* of the sheet material 61 in a direction away from the inner surface of the wall portion 52*a*. As a result, an area of the sheet material 61 on the upstream side of the pad 51 in the rotation direction of the belt 43 is displaced in a direction away from the inner surface of the belt 43. The area includes the corner portion 61*a*. Consequently, the volume of the lubricant-retaining space S becomes larger than that when the fixing operation stops (at the time of non-heating). In this manner, the elastic container 74 deforms itself due to a temperature change, thereby varying the volume of the lubricant-retaining space S. Then, the volume of the lubricant-retaining space S becomes larger when the belt is heated by the heating unit 44 than when the belt is not heated.

According to the configuration of the ninth embodiment, it is possible to vary the volume of the lubricant-retaining space S by using the elastic container 74 (vacuum chamber) that is a relatively small and highly versatile functional member. Therefore, it is possible to reduce the size and cost of the image forming apparatus 1.

Tenth Embodiment

Figure 17:
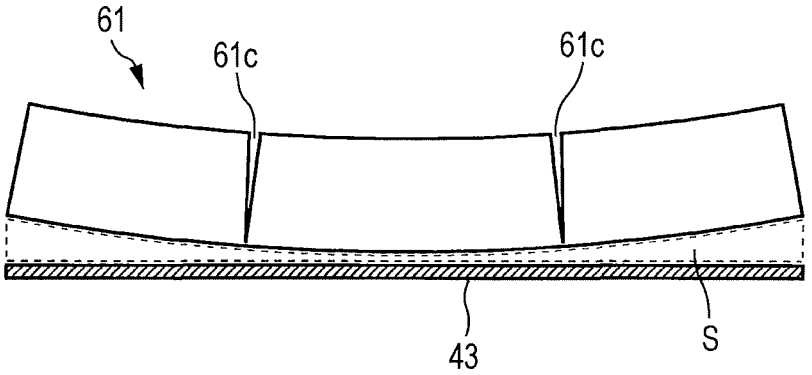
FIG. 17 is a side view illustrating a lubricant supplier of a fixing device of an image forming apparatus according to a tenth embodiment of the present invention.

Next, an image forming apparatus according to a tenth embodiment of the present invention will be described with reference to FIG. 17. FIG. 17 is a side view illustrating a lubricant supplier of a fixing device of the image forming apparatus. Note that since the basic configuration of this embodiment is the same as that of the first embodiment described above, the same names and reference numerals as those in the first embodiment are given to the same constituent components as those in the first embodiment, and the detailed description thereof may be omitted.

In the fixing device 40 of the image forming apparatus 1 according to the tenth embodiment, a lubricant supplier 60 illustrated in FIG. 17 includes a sheet material 61.

The sheet material 61 has a plurality of cutout portions 61*c*. For example, two cutout portions 61*c* are disposed side by side along the paper width direction (horizontal direction in FIG. 17). The cutout portions 61*c* extend in parallel along the rotation direction of a belt 43 (vertical direction in FIG. 17), and are formed in a V-shape, for example.

The surface of the sheet material 61 facing a lubricant-retaining space S on the upstream side of a nip former 50 in the rotation direction of the belt 43 is curved such that the center portion of the surface forms a shape projected downward along the paper width direction. As a result, the volume of the lubricant-retaining space S is larger at both ends in the paper width direction (rotating shaft direction) of the belt 43 than at the center portion therein.

As described above, according to the configuration of the tenth embodiment, the sheet material 61 includes the cutout portions 61*c* extending in parallel along the rotation direction of the belt 43. Therefore, even in a case where curling or undulation of the sheet material 61 occurs, the sheet material 61 as a whole can be flattened by correcting the curling or undulation. Therefore, lubricant can be stably supplied between the inner surface of the belt 43 and the nip former 50, and the life of the image forming apparatus 1 can be extended.

Furthermore, the volume of the lubricant-retaining space S is larger at both ends in the paper width direction of the belt 43 than at the center portion therein. Therefore, it is possible to suppress an occurrence of a clearance of the lubricant, which may occur in a case where the volume of the lubricant-retaining space S at both ends in the paper width direction of the belt 43 is smaller than at the center portion therein. This makes it possible to prevent a shortage of the lubricant. It is also possible to hold a relatively large amount of the lubricant at both ends in the paper width direction of the belt 43 and to suppress leakage of the lubricant to the outside from the end in the paper width direction of the belt 43. Therefore, it is possible to prevent malfunction of the apparatus and deterioration of the image quality caused by the malfunction. Furthermore, excessive supply of the lubricant between the inner surface of the belt 43 and the nip former 50 can also be suppressed.

The present invention can be used in an image forming apparatus provided with a fixing device.

Although embodiments of the present invention have been described and illustrated in detail, it is clearly understood that the same is by way of illustration and example only and not limitation, the scope of the present invention should be interpreted by terms of the appended claims. Various modifications can be made without departing from the spirit of the invention.

What is claimed is:

1. An image forming apparatus comprising a fixing device that forms a fixing nip by a pressure rotator and a fixing belt that rotates while contacting the pressure rotator, the image forming apparatus comprising:

a nip former that is disposed inside the fixing belt and that forms the fixing nip between the pressure rotator and the fixing belt; and a lubricant supplier that forms a lubricant-retaining space at a position between an inner surface of the fixing belt and the nip former on an upstream side of the nip former in a rotation direction of the fixing belt, wherein the lubricant supplier varies a volume of the lubricant-retaining space at a particular location.

2. The image forming apparatus according to claim 1, wherein the lubricant supplier varies the volume of the lubricant-retaining space according to the number of times of fixing operations.

3. The image forming apparatus according to claim 1, wherein the lubricant supplier varies the volume of the lubricant-retaining space in conjunction with a rotation operation of the pressure rotator.

4. The image forming apparatus according to claim 1, wherein the lubricant supplier varies the volume of the lubricant-retaining space in conjunction with an operation of changing a rotation speed of the pressure rotator.

5. The image forming apparatus according to claim 1, further comprising a pressure mechanism that brings the pressure rotator and the fixing belt into and out of contact with each other, wherein the lubricant supplier varies the volume of the lubricant-retaining space in conjunction with an operation of the pressure mechanism.

6. The image forming apparatus according to claim 1, further comprising a temperature detector that detects a temperature of the fixing belt, wherein the lubricant supplier varies the volume of the lubricant-retaining space on the basis of the temperature detected by the temperature detector.

7. The image forming apparatus according to claim 1, wherein the lubricant supplier includes a supply member that varies the volume of the lubricant-retaining space, and the supply member deforms itself due to a temperature change and as a result varies the volume of the lubricant-retaining space.

8. The image forming apparatus according to claim 7, wherein the supply member includes two materials having different coefficients of thermal expansion.

9. The image forming apparatus according to claim 7, wherein the supply member includes a shape memory alloy.

10. The image forming apparatus according to claim 7, wherein the supply member includes an elastic container the interior of which is vacuum and hermetically sealed.

11. The image forming apparatus according to claim 1, wherein the volume of the lubricant-retaining space becomes larger toward an upstream in the rotation direction of the fixing belt.

12. The image forming apparatus according to claim 1, wherein the volume of the lubricant-retaining space is wider at both ends in a rotating shaft direction of the fixing belt than a center portion in the rotating shaft direction of the fixing belt.

13. The image forming apparatus according to claim 1, wherein the lubricant supplier includes a sheet material that is disposed to face the inner surface of the fixing belt and extends from an area where the nip former faces the inner surface of the fixing belt to an upstream side of the nip former in the rotation direction of the fixing belt.

14. The image forming apparatus according to claim 13, wherein the sheet material is fixed to the nip former in the area where the nip former faces the inner surface of the fixing belt.

15. The image forming apparatus according to claim 13, wherein the sheet material includes an engaging portion that blocks an upstream end in the rotation direction of the fixing belt from approaching the inner surface of the fixing belt beyond a predetermined distance.

16. The image forming apparatus according to claim 13, wherein the sheet material includes a cutout portion extending in parallel along the rotation direction of the fixing belt.

17. The image forming apparatus according to claim 13, wherein the supply member is disposed to face a surface of the sheet material opposite to a surface facing the inner surface of the fixing belt in an area on the upstream side of the nip former in the rotation direction of the fixing belt.

18. The image forming apparatus according to claim 1, wherein in the lubricant supplier, an surface oil separation property is higher in an area near an upstream end in the rotation direction of the fixing belt than in an area on a downstream side in the rotation direction of the fixing belt, among areas facing the lubricant-retaining space.

19. The image forming apparatus according to claim 18, wherein in the lubricant supplier, a surface irregularity is smaller in the area near the upstream end in the rotation direction of the fixing belt than in the area on the downstream side in the rotation direction of the fixing belt, among the areas facing the lubricant-retaining space.

20. An image forming apparatus comprising a fixing device that forms a fixing nip by a pressure rotator and a fixing belt that rotates while contacting the pressure rotator, the image forming apparatus comprising:

a nip former that is disposed inside the fixing belt and that forms the fixing nip between the pressure rotator and the fixing belt; and a lubricant supplier that forms a lubricant-retaining space at a position between an inner surface of the fixing belt and the nip former on an upstream side of the nip former in a rotation direction of the fixing belt;

wherein the lubricant supplier varies a volume of the lubricant-retaining space; and wherein the volume of the lubricant-retaining space is larger when the fixing belt is heated than when the fixing belt is not heated.

21. A fixing device that forms a fixing nip by a pressure rotator and a fixing belt that rotates while contacting the pressure rotator, the fixing device comprising:

a nip former that is disposed inside the fixing belt and that forms the fixing nip between the pressure rotator and the fixing belt; and a lubricant supplier that forms a lubricant-retaining space at a position between an inner surface of the fixing belt and the nip former on an upstream side of the nip former in a rotation direction of the fixing belt, wherein the lubricant supplier varies a volume of the lubricant-retaining space at a particular location.

* * * * *